United States Patent [19]

Knox

[11] Patent Number: 4,610,055

[45] Date of Patent: Sep. 9, 1986

[54] BUCKLE TIEDOWN ASSEMBLY

[75] Inventor: Howard T. Knox, Simi, Calif.

[73] Assignee: Ancra Corporation, El Segundo, Calif.

[21] Appl. No.: 768,675

[22] Filed: Aug. 23, 1985

Related U.S. Application Data

[63] Continuation-in-part of Ser. No. 624,409, Jun. 25, 1984.

[51] Int. Cl.[4] ..... A44B 11/12; A44B 21/00

[52] U.S. Cl. ..... 24/68 CD; 24/68 E; 24/171; 24/193; 24/197

[58] Field of Search ..... 24/68 CD, 68 E, 68 R, 24/68 CT, 265 CD, 270, 271, 273, 170, 171, 173, 191, 193

[56] References Cited

U.S. PATENT DOCUMENTS

| | | | |
|---|---|---|---|
| 519,546 | 5/1894 | McClure | 24/193 |
| 1,517,536 | 12/1924 | Cull et al. . | |
| 1,636,638 | 7/1927 | Jenkins . | |
| 2,442,266 | 5/1948 | Davis | 24/193 |
| 2,825,109 | 3/1958 | Nelson . | |
| 2,972,173 | 2/1961 | Weber | 24/171 |
| 2,997,761 | 8/1961 | Davis | 24/68 E |
| 3,060,537 | 10/1962 | Hatfield | 24/197 |
| 3,252,188 | 5/1966 | Davis | 24/68 E |
| 3,289,261 | 12/1966 | Davis | 24/193 |
| 3,349,449 | 10/1967 | Hatfield | 24/197 |
| 3,449,798 | 6/1969 | Hofmann . | |
| 3,538,553 | 11/1970 | Brucker . | |
| 3,893,210 | 7/1975 | Hildebrandt | 24/171 |
| 4,073,317 | 2/1978 | Ellis . | |
| 4,118,833 | 10/1978 | Knox et al. | 24/68 CD |
| 4,324,022 | 4/1982 | Prete, Jr. | 24/68 CD |
| 4,414,713 | 11/1983 | Prete, Jr. | 24/193 |
| 4,464,811 | 8/1984 | Holmes | 24/68 CD |

FOREIGN PATENT DOCUMENTS

| | | | |
|---|---|---|---|
| 1268551 | 3/1972 | United Kingdom | 24/68 CD |

*Primary Examiner*—Victor N. Sakran

*Attorney, Agent, or Firm*—Edward A. Sokolski

[57] ABSTRACT

A two piece buckle has a frame member and a bale member which is pivotally supported on the frame member. The frame member includes a central elongated substantially flat piece and a pair of arm members extending from the edges of the central piece at an angle of substantially 90 degrees. These arm members have a pair of apertures formed therein which provide sockets into which the opposite ends of the bale fit. A pair of detents which are in the form of protrusions extend outwardly from the frame arm members. The bale member is resilient such that the bale member can be pivotally moved over the detents and thus positioned on either side thereof. The central piece of the frame has a first cross arm with an elongated slot formed on either side thereof and a second cross arm spaced from the first cross arm by one of said slots, a clamp member being slidably mounted on the second cross arm. A first strap is reeved through the slots and runs around the slidable clamp member, a second strap being attached to the bale member. When tension is placed on the first strap, the slidable clamp member is drawn towards the first cross member to clamp the strap against this cross member preventing slippage thereof particularly under repeated load cycling.

4 Claims, 3 Drawing Figures

BUCKLE TIEDOWN ASSEMBLY

This application is a continuation-in-part of my application Ser. No. 624,409, filed June 25, 1984.

This application relates to a buckle-tiedown assembly and more particularly to such an assembly employing a bale member through which one strap is attached and which is pivotally supported on a frame member to which a second strap is attached, the buckle being used to tighten the strap.

In my patent application Ser. No. 624,409, filed June 25, 1984 of which the present application is a continuation in part, a buckle-strap tiedown assembly is described which is suitable for use in tying down cargo for transportation. The device of this prior application includes a frame member having a generally flat central piece and a pair of opposite legs which extend normally from the edges of the central piece. The legs of the central piece have a pair of oppositely positioned apertures formed therein into which the ends of the bale member are resilently fitted, the bale member thus being pivotally supported on the frame. The bale is resilient so that it can be snapped into position in the apertures on the frame legs along a pair of oppositely positioned ramps formed on each legs directly adjacent to the apertures. A paid of oppositely positioned detents or protrusions are formed on the outer walls of the legs.

The frame has a pair of cross arms with an elongated slot being formed therebetween and a second slot being formed between one of the cross arms and the main body portion of the frame. A first strap piece is attached to the bale member while a second strap piece is reeved through the slots formed in the frame and thus adjustably secured thereto. The buckle is in a "release" position when the bale is on one side of the detents. To tension the buckle, the frame is moved over the detents to the opposite sides thereof, the frame being prevented by the detents from going to the release position unless manually rotated over the detents to this position.

It has been found that with repeated load cycling, i.e. repeated applications and release of tension on the strap that slippage of the strap reeved through the frame can occur. The device of the present invention incorporates all of the aforementioned structure of my prior application and further includes a slidable clamp member which operates to clamp the strap against the frame when under tension so as to avoid slippage. This clamping action is achieved by means of a clamping member which is slidably supported for longitudinal motion on one of the cross arms. The strap is wound around this slidable clamping member and when tension is placed on the strap, the slidable clamping member is drawn so as to clamp the strap against the other cross arm. A stop member is provided in the clamp so as to limit its travel to avoid cutting of the strap.

It is therefore an object of this invention to provide a simple and economical buckle assembly which is capable of handling heavy loads.

It is a further object of this invention to provide a buckle assembly suitable for use in typing down cargo for transportation which is of simple construction and is easy to operate.

It is a further object of this invention to provide an improved buckle assembly suitable for use in tying down cargo for transportation in which the straps employed therein are less prone to slippage.

Other objects of this invention will become apparent as the description proceeds in connection with the accompanying drawings of which:

Figure 1:
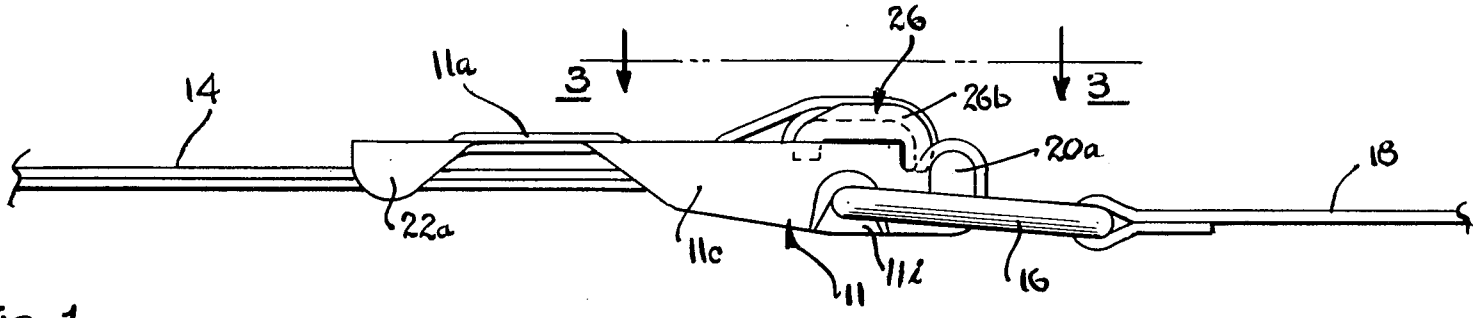
FIG. 1 is a side elevational view of a preferred embodiment of the invention.

It is to be noted that except for the addition of the slidable clamping member, that the device of the present invention is the same as that described in my aforementioned patent application, Ser. No. 624,409. Referring now to the figures, frame 11 has a substantially flat central piece 11*a* and a pair of side legs 11*b* and 11*c* extending normally from the opposite side edges of the central piece. A pair of cross arms 11*k* and 11L which runs between legs 11*b* and 11*c* are formed on the frame, there being a first slot 11*f* formed between cross arms 11*k* and 11L and a second slot 11*e* being formed between the central piece 11*a* and cross arm 11*k*. Slidable clamp member 26 is slidably retained to cross arm 11L by means of rivet 27 fixedly attached to cross arm 11L and which is fitted in enlongated slotted portion 26*a* of the clamp member. Clamp member 26 has a paid of opposing side arms 26*b* and 26*c* which form a slot for receiving strap 14. A stop arm 26*d* is provided in the clamp to limit its travel so that the space in slot 11*f* between strap 14 and cross arm 11*k* are limited to no less than 50% of the strap thickness to provide tight retention of the strap yet to avoid any cutting thereof. The strap 14 is reeved through slots 11*e* and 11*f* and wrapped around slidable clamp 26, being fitted in the slot formed between the side arms 26*b* and 26*c* thereof.

With tensioning of strap 14, slidable clamp 26 is drawn towards cross arm 11*k* clamping the strap between this cross arm and the end of the clamp. The travel of the clamp, as already noted, is limited so as to avoid over clamping of the strap which might result in the cutting thereof.

Bale member 16 is generally U-shaped and has a circular cross section, with a pair of turned in open end portions which are snapped in position in apertures formed in the frame by being slided along ramps 11*i* of the frame. Strap section 18 is fixed in position on bale 16 by stitching. Strap 14 can be adjusted insofar as effective length is concerned with the buckle in its release position.

Figure 2:
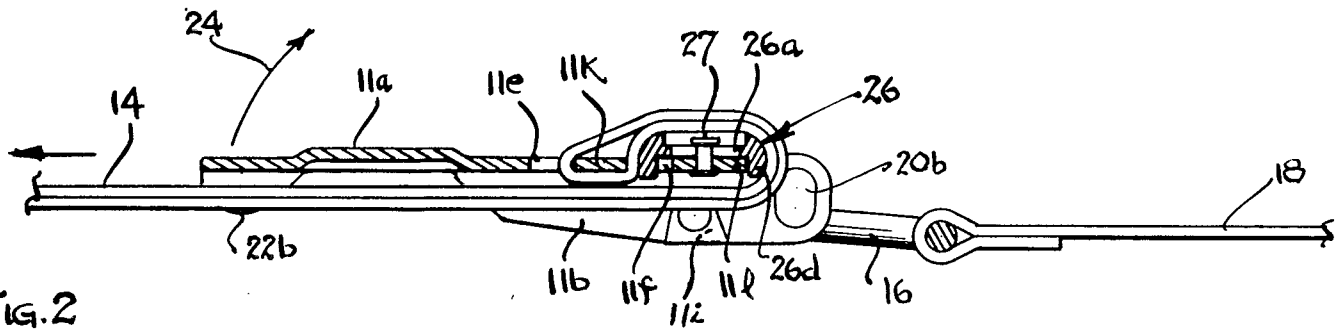
FIG. 2 is a side elevational view in cross-section of the preferred embodiment.
Figure 3:
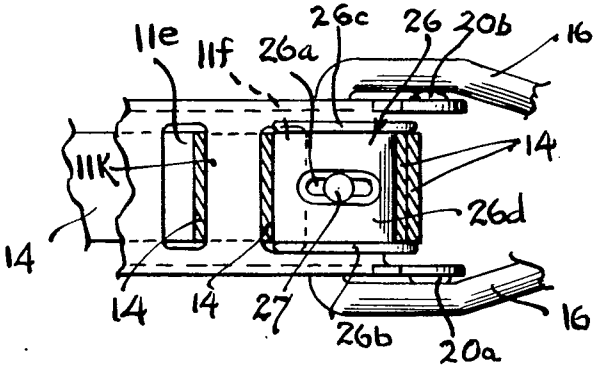
FIG. 3 is a top plan view taken along the plane indicated by 3—3 in FIG. 1.

Detents or protrusions 20*a* and 20*b* are formed on the walls of legs 11*b* and 11*c* respectively near the ends of these legs. The buckle is shown in the figures in its tensioned position with the arms of bale 16 on one side of detents 20*a* and 20*b*. To release the buckle, the frame is moved as indicated by arrow 24 in FIG. 2, the arms of the bale 16 riding resiliently over the detents to the opposite side thereof. A finger grip is provided by widened end flanges 22*a* and 22*b* to facilitate the manipulation of the frame.

While the invention has been described and illustrated in detail, it is to clearly understood that this is intended by way of illustration example only and it is not to be taken by way of limitation, the spirit and the scope of the invention being limited only by the terms of the following claims.

I claim:

1. A buckle assembly for tightening and securing a pair of straps or the like around a load to be retained in place comprising:

a frame member having a generally elongated flat central piece and a pair of opposing legs which extend normally from opposite edges of said central piece, said legs having oppositely positioned apertures formed therein towards one end thereof and detents or protrusions extending outwardly from said legs at a position therealong between said apertures and said one end thereof, first and second cross arms running between said legs, there being a first slot formed between said first and second cross arms and a second slot formed between said first cross arms and said central piece, a resilient generally U-shaped bale member having turned in end portions, said end portions being fitting into the apertures of the frame legs to pivotally support the bale member thereon, a clamping member, and means for slidably mounting said clamping member on said first cross arm, one of said straps being fixedly retained on the bale member, the other of said straps being reeved through the slots of the central piece of the frame member and wrapped around the clamping member for adjustment relative thereto, said clamping member being slidably drawn to clamp the other of said straps against the second cross arm when the other of said straps is tensioned, the frame member being movable between a "tension" position with the bale on one side of said detents and a "release" position with the bale on the other side of said detents.

2. The buckle assembly of claim 1 wherein said clamp has side arms forming a slot in which the other of said straps is positioned.

3. The buckle assembly of claim 1 wherein the means for slidably mounting said clamp on said first cross arm comprises a slot formed in said clamp and post means fixedly mounted on said first cross arm, said post means being slidably fitted in said slot.

4. The buckle assembly of claim 3 and further including stop means extending from said clap for limiting the travel of said clamp so as to avoid over clamping of the other of the straps.

* * * * *